US007510777B2

(12) United States Patent
Darolia et al.

(10) Patent No.: US 7,510,777 B2
(45) Date of Patent: Mar. 31, 2009

(54) COMPOSITE THERMAL BARRIER COATING WITH IMPROVED IMPACT AND EROSION RESISTANCE

(75) Inventors: Ramgopal Darolia, West Chester, OH (US); Brian Thomas Hazel, West Chester, OH (US)

(73) Assignee: General Electric Company, Schenectady, NY (US)

( * ) Notice: Subject to any disclaimer, the term of this patent is extended or adjusted under 35 U.S.C. 154(b) by 327 days.

(21) Appl. No.: 11/306,125

(22) Filed: Dec. 16, 2005

(65) Prior Publication Data

US 2007/0141367 A1 Jun. 21, 2007

(51) Int. Cl.
*B32B 9/00* (2006.01)

(52) U.S. Cl. ..... 428/469; 428/472; 428/681

(58) Field of Classification Search ..... None
See application file for complete search history.

(56) References Cited

U.S. PATENT DOCUMENTS 5,059,095 A * 10/1991 Kushner et al. ..... 416/241 B
5,683,825 A 11/1997 Bruce et al.
6,544,665 B2 4/2003 Rigney et al.
6,617,049 B2 9/2003 Darolia et al.
6,620,525 B1 9/2003 Rigney et al.
6,663,983 B1 12/2003 Darolia et al.
6,720,038 B2 4/2004 Darolia et al.

* cited by examiner

*Primary Examiner*—Timothy M Speer
(74) *Attorney, Agent, or Firm*—William Scott Andes; Gary M. Hartman; Domenica N. S. Hartman

(57) ABSTRACT

A thermal barrier coating (TBC) for a component intended for use in a hostile environment, such as a component of a gas turbine engine. The TBC exhibits improved impact and erosion resistance as a result of being a composite material consisting essentially of particles of a ceramic reinforcement material dispersed in a ceramic matrix material. The ceramic reinforcement material has a yield strength greater than the ceramic matrix material at about 1100° C., and the particles of the ceramic reinforcement material have an average maximum dimension of greater than five micrometers.

24 Claims, 1 Drawing Sheet

COMPOSITE THERMAL BARRIER COATING WITH IMPROVED IMPACT AND EROSION RESISTANCE

BACKGROUND OF THE INVENTION

This invention relates to coatings for components exposed to high temperatures, such as the hostile thermal environment of a gas turbine engine. More particularly, this invention is directed to a thermal barrier coating (TBC) that exhibits improved impact and erosion resistance as a result of being a composite material containing a ceramic reinforcement material embedded in a ceramic matrix material.

Components within the hot gas path of a gas turbine engine are often protected by a thermal barrier coating (TBC) system. TBC systems include a thermal-insulating ceramic topcoat, referred to as the TBC, typically bonded to the component with an environmentally-protective bond coat. Bond coat materials widely used in TBC systems include overlay coatings such as MCrAlX (where M is iron, cobalt and/or nickel, and X is yttrium or another rare earth or reactive element such as hafnium, zirconium, etc.), and diffusion coatings such as diffusion aluminides, notable examples of which are NiAl and NiAl(Pt). Ceramic materials and particularly binary yttria-stabilized zirconia (YSZ) are widely used as TBC materials because of their high temperature capability, low thermal conductivity, and relative ease of deposition by plasma spraying, flame spraying and physical vapor deposition (PVD) techniques.

TBC's employed in the highest temperature regions of gas turbine engines are often deposited by electron beam physical vapor deposition (EBPVD), which yields a columnar, strain-tolerant grain structure that is able to expand and contract without causing damaging stresses that lead to spallation of the TBC. Similar columnar microstructures can be produced using other atomic and molecular vapor processes, such as sputtering (e.g., high and low pressure, standard or collimated plume), ion plasma deposition, and all forms of melting and evaporation deposition processes (e.g., cathodic arc, laser melting, etc.). In contrast, plasma spraying techniques such as air plasma spraying (APS) deposit TBC material in the form of molten "splats," resulting in a TBC characterized by flat (noncolumnar) grains and a degree of inhomogeneity and porosity that reduces heat transfer through the TBC.

While YSZ TBC's are widely employed for their desirable thermal and adhesion characteristics, they are susceptible to damage within the hot gas path of a gas turbine engine. For example, YSZ coatings are known to be susceptible to thinning from damage by particles of varying sizes that are generated upstream in the engine or enter the high velocity gas stream through the air intake of a gas turbine engine. The damage can be in the form of erosive wear (generally from smaller particles, lower particle velocities, and/or lower impingement angles) and impact spallation (generally from larger particles, greater particle velocities, and/or greater impingement angles). Impact damage and the resulting loss of TBC particularly occur along the leading edges of components such as turbine blades, while erosion is more prevalent on the concave and convex surfaces of the blades, depending on the particular blade design. Both forms of damage not only shorten component life, but also lead to reduced engine performance and fuel efficiency.

In commonly-assigned U.S. Pat. No. 5,683,825 to Bruce et al., an erosion-resistant TBC is disclosed in which alumina ($Al_2O_3$) or silicon carbide (SiC) is deposited as a protective coating on a TBC, or co-deposited with the TBC material to form a dispersion of particles in the TBC. Other examples of strengthening a TBC material through precipitate or particle dispersions include commonly-assigned U.S. Pat. No. 6,617,049 to Darolia et al. and U.S. Pat. No. 6,663,983 to Darolia et al., which disclose the inclusion of fine precipitates or particles on the order of up to five micrometers in diameter to provide a dispersion-hardening effect. Another use for fine precipitates in a TBC is taught in commonly-assigned U.S. Pat. No. 6,544,665 to Rigney et al., who disclose a TBC containing small amounts of alumina precipitates dispersed throughout its grain boundaries and pores to inhibit grain sintering and coarsening and pore coarsening that would lead to increased thermal conductivity.

Notwithstanding the above advances, there is still an ongoing need for TBC's that exhibit improved resistance to impact spallation and erosion for more demanding engine designs.

BRIEF SUMMARY OF THE INVENTION

The present invention generally provides a thermal barrier coating (TBC) for a component intended for use in a hostile environment, such as the superalloy turbine, combustor and augmentor components of a gas turbine engine. The TBC of this invention exhibits improved impact and erosion resistance as a result of being a composite material consisting essentially of particles of a ceramic reinforcement material dispersed in a ceramic matrix material. The ceramic reinforcement material has a yield strength greater than the ceramic matrix material at about 1100° C., and the particles of the ceramic reinforcement material have an average maximum dimension of greater than five micrometers.

The particles of the ceramic reinforcement material are preferably of a sufficient size and present in a sufficient amount to structurally reinforce the ceramic matrix material. Improved impact and erosion resistance is believed to be attributable at least in part to the particles providing crack blunting and crack deflection that inhibit crack propagation through the ceramic matrix material. As such, the invention is directed to relatively large particles of ceramic reinforcement material that are intentionally larger than the fine particle dispersions previously proposed for dispersion strengthening TBC materials to improve impact and erosion resistance. The ceramic reinforcement material can be co-deposited with the ceramic matrix material through various processes, including physical vapor deposition and plasma spraying.

Other objects and advantages of this invention will be better appreciated from the following detailed description.

DETAILED DESCRIPTION OF THE INVENTION

Figure 1:
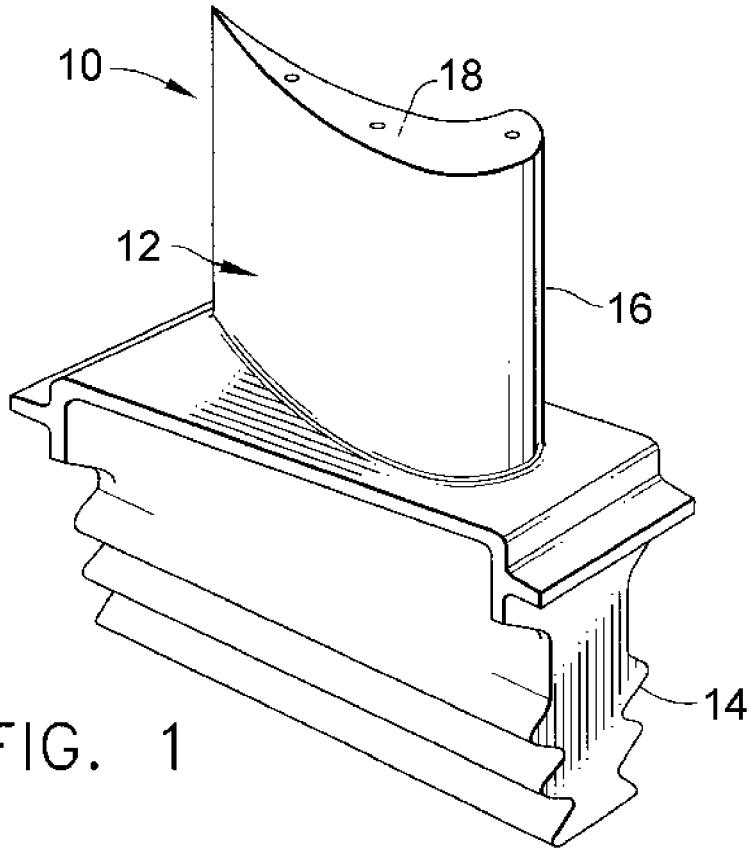
FIG. 1 is a perspective view of a high pressure turbine blade.

While the present invention is applicable to a variety of components subjected to high temperatures, such as the high and low pressure turbine nozzles and blades, shrouds, centerbodies, combustor liners, and deflectors of gas turbine engines, the invention will be discussed in reference to a high pressure turbine (HPT) blade 10 shown in FIG. 1. The blade 10 generally includes an airfoil 12 against which hot combustion gases are directed during operation of the gas turbine engine, and whose surfaces are therefore subjected to heat, oxidation, and corrosion from the combustion gases as well as impact and erosion damage from particles entrained in the combustion gases. The airfoil 12 is shown as configured for being anchored to a turbine disk (not shown) with a dovetail 14. For purposes of the following description, the leading edge 16 and the concave (pressure) surface 18 of the airfoil 12 are also identified in FIG. 1.

Figure 2:
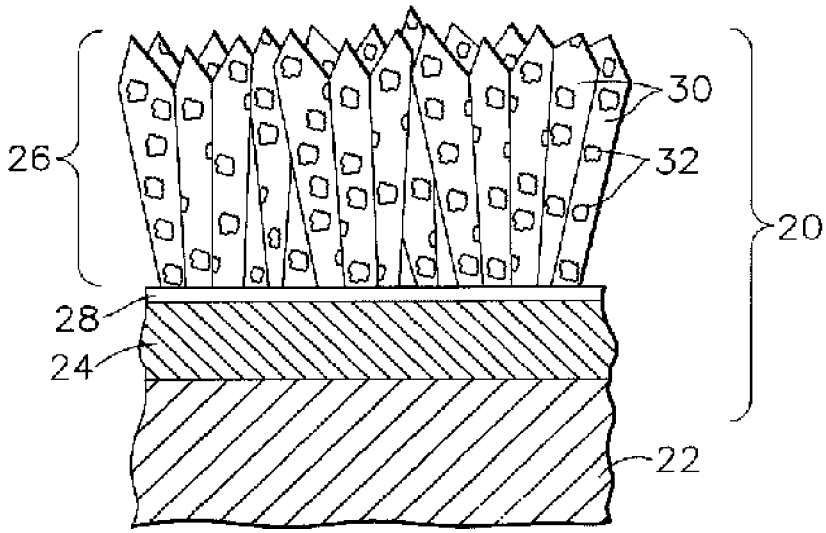
FIG. 2 is a cross-sectional view of a surface region of the blade of FIG. 1, and shows a thermal barrier coating system on the blade in accordance with this invention.

To protect the airfoil 12 from its hostile operating environment, at least the surfaces of the airfoil 12 are proved with a thermal barrier coating (TBC) system 20, which is schematically depicted in FIG. 2 in accordance with the present invention. The TBC system 20 is represented as being anchored with a metallic bond coat 24 to a surface region 22 of the airfoil 12, which is usually a nickel, cobalt, or iron-based superalloy. As is typical with TBC systems for components of gas turbine engines, the bond coat 24 is preferably an aluminum-rich composition of a type known in the art, such as an overlay coating of a beta-phase NiAl intermetallic or an MCrAlX alloy, or a diffusion coating such as a diffusion aluminide or a diffusion platinum aluminide, as well as other bond coat materials currently being considered. The bond coat 24 is represented as having developed an aluminum oxide (alumina) scale 28 as a result of oxidation, such as during deposition of the TBC 26 on the bond coat 24, as well as subsequent high temperature excursions of the blade 10 during engine operation. The alumina scale 28 chemically bonds the TBC 26 to the bond coat 24 and substrate 22.

The TBC 26 is represented in FIG. 2 as having a strain-tolerant microstructure of columnar grains 30. As known in the art, such columnar microstructures can be achieved by depositing the TBC 26 using a physical vapor deposition technique, such as EBPVD or another atomic and molecular vapor process, as well as known melting and evaporation deposition processes. While the following discussion will focus on columnar TBC of the type shown in FIG. 2, the invention is also applicable to noncolumnar TBC deposited by such methods as plasma spraying, including air plasma spraying (APS). The microstructure of this type of TBC is characterized by splat-shaped (i.e., irregular and flattened) grains and a degree of inhomogeneity and porosity. The TBC 26 is deposited to a thickness that is sufficient to provide the required thermal protection for the underlying surface region 22 of the airfoil 12, generally on the order of about 75 to about 300 micrometers.

As previously noted, the leading edge 16 and the pressure surface 18 of the blade airfoil 12 are susceptible to damage by particles in the high velocity gas stream of a gas turbine engine. Damage to the leading edge 16 is generally from impact with large particles and/or particles at greater velocities and/or greater impingement angles, while damage to the pressure surface 18 is generally in the form of erosive wear from smaller particles, lower particle velocities, and/or lower impingement angles. Impacting particles generate stress waves in the outer surface regions of the impacted columnar grains 30. The stress waves travel downward through the impacted grains 30, arriving at the interface between the TBC 26 and bond coat 24 as reflected stress waves. The stresses generated by the stress waves are compressive in the first few grains 30, but become tensile in succeeding grains 30. When these tensile stresses reach the interface between the TBC 26 and bond coat 24, separation of the TBC 26 at the bond coat interface can occur depending on the magnitude of the tensile stresses. In such an event, the TBC 26 completely separates (spalls) from the bond coat 24 from a mechanism referred to herein as impact spallation. Alternatively, particle impact can cause cracking within the TBC grains 30 as a result of the stresses exceeding the cracking threshold of the TBC material, causing erosion damage.

To increase erosion resistance and particularly impact spallation resistance, the TBC 26 of this invention is depicted as having been deposited so that its individual columnar grains 30 are made up of a ceramic matrix material in which relatively large particles 32 of an insoluble ceramic reinforcement material are uniformly dispersed. As such, the TBC 26 is a composite material consisting essentially of the particles 32 of sufficient size to reinforce the ceramic matrix material making up the balance of the TBC 26. According to the invention, the ceramic reinforcement material of the particles 32 is also characterized by a greater yield strength than the ceramic matrix material in which they are dispersed, with the result that the particles 32 promote the mechanical properties of the TBC 26. In particular, the ceramic reinforcement material exhibits greater yield strength than the ceramic matrix material at temperatures sustained by the TBC 26 during engine operation, generally in the range of about 1800° F. to about 2200° F. (about 980° C. to about 1315° C.).

A variety of ceramic matrix materials can be employed with the present invention. A preferred ceramic matrix material is yttria-stabilized zirconia (YSZ), with suitable compositions containing about 2 to about 20 weight percent yttria (2-20% YSZ), more preferably about 3 to about 8 weight percent yttria (3-8% YSZ). Other ceramic materials are also suitable for the ceramic matrix material, such as YSZ modified with additional oxides to reduce thermal conductivity, and zirconia stabilized by other oxides such as magnesia, ceria, calcia, scandia, etc. Other notable materials suitable for the ceramic matrix material include those formulated to have lower coefficients of thermal conductivity than 7% YSZ, examples of which are disclosed in commonly-assigned U.S. Pat. No. 6,586,115 to Rigney et al., U.S. Pat. No. 6,686,060 to Bruce et al., U.S. Pat. No. 6,808,799 to Darolia et al., and U.S. Pat. No. 6,890,668 to Bruce et al., commonly-assigned U.S. patent application Ser. No. 10/063,962 to Bruce, and U.S. Pat. No. 6,025,078 to Rickerby.

In view of the variety of materials suitable for the ceramic matrix material, there are potentially a wide variety of ceramic materials suitable for use as the reinforcement material. A fundamental requirement of suitable reinforcement materials is insolubility in the ceramic matrix material, so that the particles 32 will remain as discrete particles that will not alloy with the ceramic matrix material. As such, preferred reinforcement materials for a particular application will depend in part on the ceramic matrix material being reinforced with the reinforcement particles 32. If the ceramic matrix material of the TBC 26 is YSZ, particularly suitable reinforcement materials are believed to be alumina and chromia, both of which are insoluble in YSZ and have yield strengths that exceed the yield strength of 6-8% YSZ at 1100° C. Notably, an additional benefit of using alumina as the reinforcement material is enhanced resistance to spallation from contamination by compounds such as CMAS (a low-melting compound of calcia, magnesia, alumina and silica). As reported in commonly-assigned U.S. Pat. Nos. 5,660,885, 5,683,825, 5,871,820, 5,914,189, alumina is capable of interacting with molten CMAS to form a compound with a melting temperature that is significantly higher than CMAS, so that the reaction product of CMAS and alumina does not melt and infiltrate the TBC 26.

The particles 32 of the ceramic reinforcement material must be of sufficient size and present in a sufficient amount to structurally reinforce the ceramic matrix material and thereby contribute significantly to the mechanical properties of the TBC 26. In particular, relative large particles 32 are believed to be able to improve impact and erosion resistance by providing crack blunting and crack deflection that inhibit crack propagation through the ceramic matrix material. For this reason, the particles 32 preferably have an average maximum dimension of at least five micrometers, preferably up to about 10 micrometers. The reinforcement particles 32 are preferably present in an amount of at least 0.1 weight percent of the TBC 26 in order to contribute to the mechanical properties of the TBC 26. A suitable upper limit is about 20 weight percent, with a preferred range being about 2 to about 10 weight percent.

The ceramic reinforcement material can be co-deposited with the ceramic matrix material through various processes, including physical vapor deposition (PVD) and plasma spraying. A suitable process for depositing the columnar TBC 26 of FIG. 2 is a PVD process such as EBPVD, which generally entails supporting a component (such as the blade 10 of FIG. 1) in proximity to one or more ingots of the desired coating materials, and then projecting one or more electron beams onto the ingot(s) so as to evaporate the ingots and produce a vapor that deposits (condenses) on the component surface. While similar in most respects to conventional EBPVD, the process for depositing the columnar TBC 26 of this invention requires that a source of the ceramic matrix material (e.g., yttria and zirconia) and a source of the ceramic reinforcement material (e.g., alumina and/or chromia) are both present. For example, the TBC 26 can be deposited by simultaneously evaporating separate ingots of YSZ and alumina and/or chromia. Alternatively, a single ingot containing YSZ and alumina and/or chromia regions or a dispersion of alumina and/or chromia can be evaporated to produce the TBC 26. Other process variables or fixturing, such as rotation and masking of a component, can be used to selectively deposit the TBC 26 of this invention on particular surface regions of the component that are relatively more prone to damage, such as the leading edge 16 or the pressure surface 18 of the blade 10.

In investigations leading to this invention, YSZ TBC's having nominal yttria contents of about seven weight percent were deposited by EBPVD to have thicknesses of about 125 micrometers. Each of the TBC's were deposited on pin specimens formed of René N5 (nominal composition of, by weight, about 7.5% Co, 7.0% Cr, 6.5% Ta, 6.2% Al, 5.0% W, 3.0% Re, 1.5% Mo, 0.15% Hf, 0.05% C, 0.004% B, 0.01% Y, the balance nickel and incidental impurities), on which a platinum aluminide (PtAl) bond coat had been previously deposited. The microstructures of the TBC's differed from each other as a result of a control group of the specimens being deposited to consist entirely of 7% YSZ, while other (experimental) specimens were deposited to contain up to about 10 weight percent of either alumina or chromia. Processing difficulties were encountered when depositing the alumina specimens, resulting in a layered structure instead of the composite reinforcement of this invention. For this reason, the alumina specimens are not further discussed below.

The impact performance of the chromia-containing test specimens was assessed by cycling the coated pins in and out of a jet stream into which was injected alumina particulate having an average particle size of about 560 micrometers. Coating loss was then correlated to the mass of the particulate required to spall the TBC. The results were normalized to the coating thickness and recorded in grams of particulate per one mil (25 micrometers) of coating thickness (g/mil) to permit comparison between coatings of different thicknesses. The results are summarized in Table I below for the chromia-containing specimens.

TABLE I

| SPECIMEN | MIN-IMUM | MAX-IMUM | AVERAGE |
|---|---|---|---|
| 7% YSZ (control) | 46 g/mil | 104 g/mil | 75 g/mil |
| 7% YSZ + 9.43 wt. % chromia | 15 | 15 | 15 |
| 7% YSZ + 3.07 wt. % chromia | 145 | 145 | 145 |
| 7% YSZ + 1.73 wt. % chromia | 90 | 135 | 112.5 |
| 7% YSZ + 0.83 wt. % chromia | 100 | 145 | 122.5 |
| 7% YSZ + 0.57 wt. % chromia | 85 | 115 | 100 |
| 7% YSZ + 0.14 wt. % chromia | 75 | 95 | 85 |

Examination of the 9.43% chromia specimens showed heavy layering of chromia instead of a dispersion of reinforcement particles, and the poor results of these specimens were attributed to this layered structure. Otherwise, the above results demonstrated that significant improvements in impact spallation resistance of about 100% can be achieved with 7% YSZ through additions of chromia particles.

Erosion resistance of additional specimens was assessed under similar conditions as the impact test, but with the use of a finer alumina particulate having an average particle size of about 50 micrometers. After normalizing, the results evidenced that the erosion resistance of the experimental TBC's containing alumina and chromia reinforcement material were generally the same as the control specimens.

While the invention has been described in terms of a preferred embodiment, it is apparent that other forms could be adopted by one skilled in the art. Accordingly, the scope of the invention is to be limited only by the following claims.

What is claimed is:

1. A component having a composite thermal barrier coating on a surface thereof, the composite thermal barrier coating consisting essentially of particles of an insoluble ceramic reinforcement material uniformly dispersed throughout grains having a matrix formed by a ceramic matrix material, the ceramic reinforcement material being chromia and having a yield strength greater than the ceramic matrix material at about 1100° C., each of the particles of the ceramic reinforcement material having a maximum dimension, the average of the maximum dimensions of the particles being greater than five micrometers, the composite thermal barrier coating containing a sufficient amount of the ceramic reinforcement material to increase the impact resistance of the composite thermal barrier coating.

2. A component according to claim 1, wherein the average of the maximum dimensions of the particles is about ten micrometers.

3. A component according to claim 1, wherein the ceramic reinforcement material constitutes at least 0.1 weight percent up to about 20 weight percent of the composite thermal barrier coating.

4. A component according to claim 1, wherein the ceramic reinforcement material constitutes about 1 weight percent up to about 3 weight percent of the composite thermal barrier coating.

5. A component according to claim 1, wherein the grains are columnar and the composite thermal barrier coating has a columnar grain structure.

6. A component according to claim 1, wherein the ceramic matrix material is zirconia at least partially stabilized by about 2 to about 20 weight percent yttria.

7. A component according to claim 1, wherein the ceramic matrix material is zirconia partially stabilized by 3 to 8 weight percent yttria.

8. A component according to claim 1, wherein the component is a blade of a gas turbine engine, and the composite thermal barrier coating is deposited on a leading edge of the blade.

9. A component according to claim 1, wherein the component is a blade of a gas turbine engine, and the composite thermal barrier coating is deposited on an aft pressure surface of the blade.

10. A component according to claim 1, wherein the ceramic reinforcement material constitutes more than 0.14 weight percent to less than 9 weight percent of the composite thermal barrier coating.

11. A gas turbine engine component comprising:

a superalloy substrate;

a metallic bond coat on a surface of the substrate; and a composite thermal barrier coating on the bond coat, the composite thermal barrier coating having a columnar grain structure comprising a plurality of columnar grains, each columnar grain of the columnar grain structure consisting essentially of particles of an insoluble ceramic reinforcement material uniformly dispersed throughout a matrix formed by a ceramic matrix material of yttria-stabilized zirconia, the ceramic reinforcement material being chromia and having a yield strength greater than the ceramic matrix material over a range of about 980° C. to about 1315° C., each of the particles of the ceramic reinforcement material having a maximum dimension, the average of the maximum dimensions of the particles being greater than five micrometers, the particles of the ceramic reinforcement material being of a sufficient size and present in a sufficient amount within the ceramic matrix material to structurally reinforce the ceramic matrix material and provide crack blunting and crack deflection to reduce crack propagation through the ceramic matrix material.

12. A gas turbine engine component according to claim 11, wherein the ceramic reinforcement material constitutes at least 0.1 weight percent up to about 20 weight percent of the composite thermal barrier coating.

13. A gas turbine engine component according to claim 11, wherein the ceramic reinforcement material constitutes more than 0.14 weight percent up to less than 9 weight percent of the composite thermal barrier coating.

14. A gas turbine engine component according to claim 11, wherein the ceramic reinforcement material constitutes about 1 weight percent up to about 3 weight percent of the composite thermal barrier coating.

15. A gas turbine engine component according to claim 11, wherein the ceramic matrix material is zirconia partially stabilized by 3 to 8 weight percent yttria.

16. A gas turbine engine component according to claim 11, wherein the component is a blade of a gas turbine engine, and the composite thermal barrier coating is deposited on a leading edge of the blade.

17. A gas turbine engine component according to claim 11, wherein the component is a blade of a gas turbine engine, and the composite thermal barrier coating is deposited on an aft pressure surface of the blade.

18. A gas turbine engine component according to claim 11, wherein the average of the maximum dimensions of the particles is about ten micrometers.

19. A component having a composite thermal barrier coating on a surface thereof, the composite thermal barrier coating consisting essentially of particles of an insoluble ceramic reinforcement material uniformly dispersed in grains having a matrix formed by a ceramic matrix material, the ceramic reinforcement material having a yield strength greater than the ceramic matrix material at about 1100° C., each of the particles of the ceramic reinforcement material having a maximum dimension, the average of the maximum dimensions of the particles is about ten micrometers, the composite thermal barrier coating containing a sufficient amount of the ceramic reinforcement material to increase the impact resistance of the composite thermal barrier coating.

20. A component according to claim 19, wherein the ceramic reinforcement material is at least one of alumina and chromia.

21. A component according to claim 19, wherein the ceramic reinforcement material is chromia.

22. A gas turbine engine component comprising:

a superalloy substrate;

a metallic bond coat on a surface of the substrate; and a composite thermal barrier coating on the bond coat, the composite thermal barrier coating having a columnar grain structure comprising a plurality of columnar grains, each columnar grain of the columnar grain structure consisting essentially of particles of an insoluble ceramic reinforcement material uniformly dispersed in a matrix formed by a ceramic matrix material of yttria-stabilized zirconia, the ceramic reinforcement material having a yield strength greater than the ceramic matrix material over a range of about 980° C. to about 1315° C., each of the particles of the ceramic reinforcement material having a maximum dimension, the average of the maximum dimensions of the particles is about ten micrometers, the particles of the ceramic reinforcement material being of a sufficient size and present in a sufficient amount within the ceramic matrix material to structurally reinforce the ceramic matrix material and provide crack blunting and crack deflection to reduce crack propagation through the ceramic matrix material.

23. A gas turbine engine component according to claim 22, wherein the ceramic reinforcement material is at least one of alumina and chromia.

24. A gas turbine engine component according to claim 22, wherein the ceramic reinforcement material is chromia.

* * * * *